US010011960B2

(12) United States Patent
Tani

(10) Patent No.: US 10,011,960 B2
(45) Date of Patent: Jul. 3, 2018

(54) METHOD OF DETECTING ROAD SURFACE DEGRADATION, INFORMATION PROCESS APPARATUS, AND NON-TRANSITORY COMPUTER-READABLE RECORDING MEDIUM

(71) Applicant: FUJITSU LIMITED, Kawasaki-shi, Kanagawa (JP)

(72) Inventor: Hiroyuki Tani, Katsushika (JP)

(73) Assignee: FUJITSU LIMITED, Kawasaki (JP)

( * ) Notice: Subject to any disclaimer, the term of this patent is extended or adjusted under 35 U.S.C. 154(b) by 40 days.

(21) Appl. No.: 15/237,858

(22) Filed: Aug. 16, 2016

(65) Prior Publication Data

US 2016/0356002 A1 Dec. 8, 2016

Related U.S. Application Data

(63) Continuation of application No. PCT/JP2015/057364, filed on Mar. 12, 2015.

(30) Foreign Application Priority Data

Mar. 18, 2014 (JP) ..... 2014-055518

(51) Int. Cl.
*E01C 23/01* (2006.01)
*E01C 23/07* (2006.01)

(52) U.S. Cl.
CPC ..... *E01C 23/01* (2013.01); *E01C 23/07* (2013.01)

(58) Field of Classification Search
None
See application file for complete search history.

(56) References Cited

U.S. PATENT DOCUMENTS 4,896,964 A * 1/1990 Kitazume ..... G01B 11/306 356/602
2013/0170701 A1 7/2013 Suzuki et al.
(Continued)

FOREIGN PATENT DOCUMENTS

JP 1-108595 4/1989
JP 2003-288665 10/2003
(Continued)

OTHER PUBLICATIONS

Office Action for corresponding Japanese Patent Application No. 2014-055518, dated Oct. 31, 2017.
Office Action for corresponding Chinese Patent Application No. 201580011356.8, dated Feb. 5, 2018.
Japanese Platform for Patent Information, Publication No. 2013-139671, published Jul. 18, 2013.
(Continued)

*Primary Examiner* — Andre Allen
(74) *Attorney, Agent, or Firm* — Staas & Halsey LLP

(57) ABSTRACT

In estimating the degraded position of a road surface with high accuracy, a server apparatus 210 comprising a part configured to change, when detecting a road surface degradation with respect to a certain road position based on accumulation of measurement information evaluation values at a plurality of times of a travel of a vehicle on the certain road position, detection sensitivity for the road surface degradation according to an MCI value with respect to the certain road surface position, the measurement information evaluation values being measured with an acceleration sensor installed in the vehicle and being according to road surface positions on which the vehicle has traveled.

7 Claims, 18 Drawing Sheets

(56) References Cited

U.S. PATENT DOCUMENTS

| | | | | |
|---|---|---|---|---|
| 2013/0238164 | A1* | 9/2013 | Matsuda | B60W 40/076 701/1 |
| 2016/0167669 | A1* | 6/2016 | Zhao | B60W 40/06 382/195 |
| 2016/0201277 | A1* | 7/2016 | Svantesson | E01C 23/01 73/146 |
| 2016/0258118 | A1* | 9/2016 | Jinno | B60W 40/06 |
| 2016/0356001 | A1* | 12/2016 | Shimada | E01C 23/01 |
| 2017/0282869 | A1* | 10/2017 | Tong | B60Q 9/00 |

FOREIGN PATENT DOCUMENTS

| | | |
|---|---|---|
| JP | 2005-138839 | 6/2005 |
| JP | 2007-329762 | 12/2007 |
| JP | 2008-297764 | 12/2008 |
| JP | 2013-139671 | 7/2013 |
| JP | 2014-38448 | 2/2014 |

OTHER PUBLICATIONS

Espacenet Bibliographic Data, Japanese Publication No. 2005-138839, published Jun. 2, 2005.

Espacenet Bibliographic Data, Japanese Publication No. 1-108595, published Apr. 25, 1989.

Espacenet Bibliographic Data, Japanese Publication No. 2003-288665, published Oct. 10, 2003.

Espacenet Bibliographic Data, Japanese Publication No. 2008-297764, published Dec. 11, 2008.

Espacenet Bibliographic Data, Japanese Publication No. 2007-329762, published Dec. 20, 2007.

Japanese Platform for Patent Information, Publication No. 2014-38448, published Feb. 27, 2014.

International Search Report dated Jun. 16, 2015 in corresponding International Application No. PCT/JP2015/057364**.

Written Opinion of the International Searching Authority dated Jun. 16, 2015 in corresponding International Application No. PCT/JP2014/057364.

* cited by examiner

FIG.4

400

| KILOMETER POST LAYOUT POSITION INFORMATION (VEHICLE ROAD A) | | |
|---|---|---|
| KILOMETER POST SECTION NAME | START POINT | END POINT |
| 0.1 | $(a_0, b_0)$ | $(a_1, b_1)$ |
| 0.2 | $(a_1, b_1)$ | $(a_2, b_2)$ |
| 0.3 | $(a_2, b_2)$ | $(a_3, b_3)$ |
| 0.4 | $(a_3, b_3)$ | $(a_4, b_4)$ |
| 0.5 | $(a_4, b_4)$ | $(a_5, b_5)$ |
| 0.6 | $(a_5, b_5)$ | $(a_6, b_6)$ |
| 0.7 | $(a_6, b_6)$ | $(a_7, b_7)$ |
| 0.8 | $(a_7, b_7)$ | $(a_8, b_8)$ |
| 0.9 | $(a_8, b_8)$ | $(a_9, b_9)$ |
| 1.0 | $(a_9, b_9)$ | $(a_{10}, b_{10})$ |
| 1.1 | $(a_{10}, b_{10})$ | $(a_{11}, b_{11})$ |
| | | |
| | | |
| 10.0 | $(a_{99}, b_{99})$ | $(a_{100}, b_{100})$ |

FIG.5

500

| MCI INFORMATION | | |
|---|---|---|
| VEHICLE ROAD NAME | KILOMETER POST SECTION NAME | MCI VALUE |
| VEHICLE ROAD A | 0.1 | 8 |
| VEHICLE ROAD A | 0.2 | 9 |
| VEHICLE ROAD A | 0.3 | 9 |
| VEHICLE ROAD A | 0.4 | 7 |
| VEHICLE ROAD A | 0.5 | 7 |
| VEHICLE ROAD A | 0.6 | 9 |
| VEHICLE ROAD A | 0.7 | 6 |
| VEHICLE ROAD A | 0.8 | 5 |
| VEHICLE ROAD A | 0.9 | 5 |
| VEHICLE ROAD A | 1.0 | 7 |
| VEHICLE ROAD A | 1.1 | 8 |
| | | |
| | | |
| VEHICLE ROAD A | 10.0 | 7 |

FIG.6

600

| DATE | TIME | LATITUDE | LONGITUDE | UP-DOWN DIRECTION ACCELERATION |
|---|---|---|---|---|
| 8/22/2013 | 13:41:02:302 | 35.36220932 | 137.2550964 | 9.787922 |
| 8/22/2013 | 13:41:02:802 | 35.36220932 | 137.2550964 | 9.661452 |
| 8/22/2013 | 13:41:03:302 | 35.36217880 | 137.2551575 | 9.359603 |
| 8/22/2013 | 13:41:03:802 | 35.36217880 | 137.2551575 | 9.083329 |
| 8/22/2013 | 13:41:04:302 | 35.36215591 | 137.2552185 | 8.915027 |
| 8/22/2013 | 13:41:04:802 | 35.36215591 | 137.2552185 | 8.835514 |
| 8/22/2013 | 13:41:05:302 | 35.36213684 | 137.2552643 | 8.848577 |

FIG.7

700

| EVALUATION VALUE INFORMATION | | |
|---|---|---|
| ROAD SURFACE CONDITION | EVALUATION VALUE IN CASE OF BEING GREATER THAN OR EQUAL TO VTh1 | EVALUATION VALUE IN CASE OF BEING GREATER THAN OR EQUAL TO VTh2 |
| PREDICTION MCI VALUE=9 | 1 | 2 |
| PREDICTION MCI VALUE=8 | 1 | 2 |
| PREDICTION MCI VALUE=7 | 1 | 2 |
| PREDICTION MCI VALUE=6 | 1 | 2 |
| PREDICTION MCI VALUE=5 | 1.1 | 2.3 |
| PREDICTION MCI VALUE=4 | 1.2 | 2.5 |
| PREDICTION MCI VALUE=3 | 1.4 | 3 |
| PREDICTION MCI VALUE=2 | 1.7 | 3.5 |
| PREDICTION MCI VALUE=1 | | |
| POT HOLE DETECTED | 1.2 | 1.2 |

FIG.8

800

| ACCUMULATION INFORMATION | | |
|---|---|---|
| VEHICLE ROAD NAME | KILOMETER POST SECTION NAME | ACCUMULATION VALUE |
| VEHICLE ROAD A | 0.1 | 10 |
| VEHICLE ROAD A | 0.2 | 12 |
| VEHICLE ROAD A | 0.3 | 8 |
| VEHICLE ROAD A | 0.4 | 30 |
| VEHICLE ROAD A | 0.5 | 14 |
| VEHICLE ROAD A | 0.6 | 10 |
| VEHICLE ROAD A | 0.7 | 16 |
| VEHICLE ROAD A | 0.8 | 22 |
| VEHICLE ROAD A | 0.9 | 25 |
| VEHICLE ROAD A | 1.0 | 11 |
| VEHICLE ROAD A | 1.1 | 20 |
| | | |
| | | |
| VEHICLE ROAD A | 10.0 | 17 |

FIG.9

900

| PREDICTION MCI INFORMATION | | | |
|---|---|---|---|
| KILOMETER POST SECTION NAME | START POINT | END POINT | PREDICTION MCI VALUE |
| 0.1 | $(a_0, b_0)$ | $(a_1, b_1)$ | 8 |
| 0.2 | $(a_1, b_1)$ | $(a_2, b_2)$ | 9 |
| 0.3 | $(a_2, b_2)$ | $(a_3, b_3)$ | 9 |
| 0.4 | $(a_3, b_3)$ | $(a_4, b_4)$ | 6 |
| 0.5 | $(a_4, b_4)$ | $(a_5, b_5)$ | 3 |
| 0.6 | $(a_5, b_5)$ | $(a_6, b_6)$ | 9 |
| 0.7 | $(a_6, b_6)$ | $(a_7, b_7)$ | 5 |
| 0.8 | $(a_7, b_7)$ | $(a_8, b_8)$ | 4 |
| 0.9 | $(a_8, b_8)$ | $(a_9, b_9)$ | 4 |
| 1.0 | $(a_9, b_9)$ | $(a_{10}, b_{10})$ | 7 |
| 1.1 | $(a_{10}, b_{10})$ | $(a_{11}, b_{11})$ | 7 |
| | | | |
| | | | |
| 10.0 | $(a_{99}, b_{99})$ | $(a_{100}, b_{100})$ | 6 |

FIG.13

1300

| DATE | KILOMETER POST SECTION NAME | | | | | | | | | |
|---|---|---|---|---|---|---|---|---|---|---|
| | 0.1 | 0.2 | 0.3 | 0.4 | 0.5 | 0.6 | 0.7 | ... | | 10.0 |
| 1/10/2013 | | +1 | | +1 | | | +1 | | | |
| 2/11/2013 | | | | +1.2 | | | | | | |
| 3/12/2013 | +2 | | | +1.2 | | | | | | |
| 4/13/2013 | | +1 | | +1.2 | | | +1 | | | |
| 5/14/2013 | | | | +1.2 | | | | | | |
| 6/15/2013 | | | | +2.5 | | | | | | |
| 6/15/2013 | | | | | | | | | | |

FIG.16

1600

| PREDICTION MCI INFORMATION | | | |
|---|---|---|---|
| KILOMETER POST SECTION NAME | START POINT | END POINT | PREDICTION MCI VALUE |
| 0.1 | $(a_0, b_0)$ | $(a_1, b_1)$ | 8 |
| 0.2 | $(a_1, b_1)$ | $(a_2, b_2)$ | LOW RELIABILITY |
| 0.3 | $(a_2, b_2)$ | $(a_3, b_3)$ | LOW RELIABILITY |
| 0.4 | $(a_3, b_3)$ | $(a_4, b_4)$ | 3 |
| 0.5 | $(a_4, b_4)$ | $(a_5, b_5)$ | 7 |
| 0.6 | $(a_5, b_5)$ | $(a_6, b_6)$ | 9 |
| 0.7 | $(a_6, b_6)$ | $(a_7, b_7)$ | 5 |
| 0.8 | $(a_7, b_7)$ | $(a_8, b_8)$ | 4 |
| 0.9 | $(a_8, b_8)$ | $(a_9, b_9)$ | 4 |
| 1.0 | $(a_9, b_9)$ | $(a_{10}, b_{10})$ | LOW RELIABILITY |
| 1.1 | $(a_{10}, b_{10})$ | $(a_{11}, b_{11})$ | LOW RELIABILITY |
| | | | |
| | | | |
| 10.0 | $(a_{99}, b_{99})$ | $(a_{100}, b_{100})$ | 6 |

METHOD OF DETECTING ROAD SURFACE DEGRADATION, INFORMATION PROCESS APPARATUS, AND NON-TRANSITORY COMPUTER-READABLE RECORDING MEDIUM

CROSS-REFERENCE TO RELATED APPLICATIONS

This is a continuation of International Application No. PCT/JP2015/057364, filed on Mar. 12, 2015, which is based upon and claims the benefit of priority of the prior Japanese Patent Application No. 2014-055518, filed on Mar. 18, 2014, the entire contents of which are incorporated herein by reference.

FIELD

The present invention is related to a method of detecting a road surface degradation, an information process apparatus and a program.

BACKGROUND

Conventionally, there is a case where subsidy from Land, Infrastructure and Transportation Ministry, etc., is used for cost related to repair work, etc., for a road surface. The subsidy is supplied according to an evaluation result of a road surface state based on an MCI (Maintenance Control Index) value derived from road surface condition measurement, for example. Thus, conventionally, in inspecting the road surface, the road surface condition measurement with a road surface condition vehicle is performed with respect to vehicle roads to be inspected to derive the MCI value thereof.

By the way, if the road surface condition measurement with respect to the vehicle roads to be inspected is performed by having the road surface condition vehicle travel on all the vehicle roads, it leads to the increased cost. In contrast, in recent years, abbreviated measurement with an acceleration sensor, etc., is performed to estimate a degraded position of the road surface, and then the road surface condition measurement is performed with respect to a section including the degraded position, which enables cutting the inspection cost.

CITATION LIST

Patent Literature 1

[PTL 1]
Japanese Laid-open Patent Publication No. 2005-138839
[PTL 2]
Japanese Laid-open Patent Publication No. 01-108595

However, in the case of the abbreviated measurement with the acceleration sensor, etc., it is difficult to estimate the degraded position of the road surface with high accuracy.

SUMMARY

An aspect causes a computer to execute a process, the process including changing, when detecting a road surface degradation with respect to a certain road position based on accumulation of measurement values at a plurality of times of a travel of a vehicle on the certain road position, detection sensitivity for the road surface degradation according to a road surface evaluation value associated with the certain road surface position, the measurement values being measured with an acceleration sensor installed in the vehicle and being according to road surface positions on which the vehicle has traveled.

The object and advantages of the embodiment will be realized and attained by means of the elements and combinations particularly pointed out in the claims. It is to be understood that both the foregoing general description and the following detailed description are exemplary and explanatory and are not restrictive of the invention.

BRIEF DESCRIPTION OF DRAWINGS

FIG. 4 is a diagram for illustrating an example of kilometer post layout position information.

FIG. 5 is a diagram illustrating an example of MCI information stored in the server apparatus.

FIG. 6 is a diagram illustrating an example of measurement information transmitted from a portable terminal.

FIG. 7 is a diagram for illustrating an example of evaluation value information.

FIG. 8 is a diagram for illustrating an example of accumulation information.

FIG. 9 is a diagram for illustrating an example of prediction MCI information.

FIG. 13 is a diagram illustrating an accumulation process of the evaluation value.

FIG. 16 is a diagram illustrating another example of prediction MCI information.

DESCRIPTION OF EMBODIMENTS

In the following, embodiments will be described with reference to the accompanying drawings.

In measurement of a road surface of a measurement system of a road surface state explained in embodiments described hereinafter, at first, MCI (Maintenance Control Index) values, which are derived from road surface state measurement that has been performed with respect to a vehicle road as a whole to be inspected, are used. The measurement system of a road surface state uses the derived MCI values, and measurement information obtained by abbreviated measurement of a road surface that is performed after the derivation of the MCI values to calculate prediction MCI values indicative of a degradation state of the road surface predicted in future.

In the measurement system of the road surface described hereinafter, it becomes possible to estimate, with high accuracy, a position where the road surface is degraded at timing after a lapse of a predetermined period, by calculating the prediction MCI values as described above.

At first, a work flow of a measurement work of system of a road surface, when the measurement system of the road surface state described hereinafter with reference to the embodiments described hereinafter is applied, is described.

Figure 1:
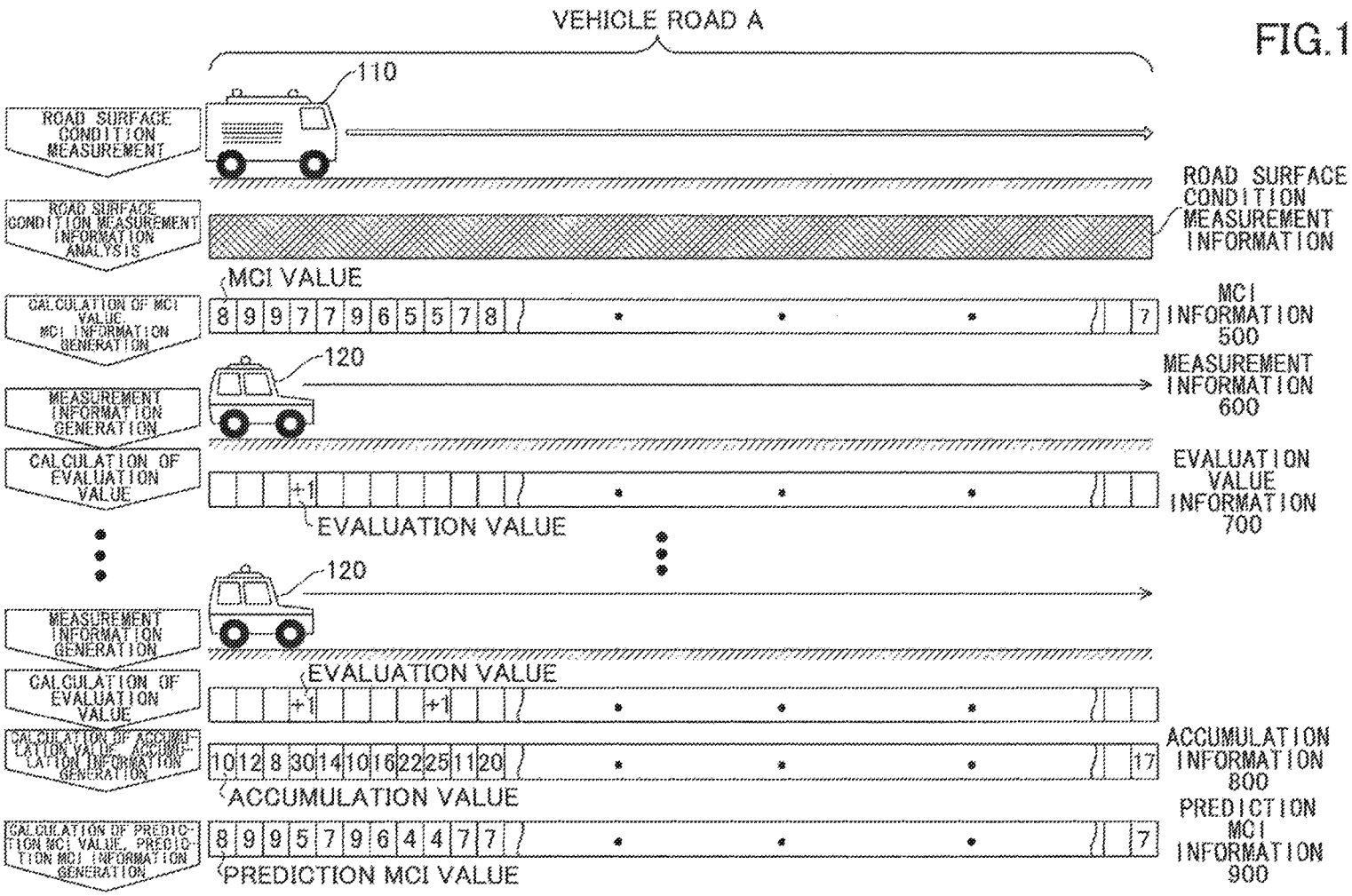
FIG. 1 is a diagram illustrating an example of a measurement work flow of a road surface state.

FIG. 1 is a diagram illustrating an example of a measurement work flow for a road surface state. When the measurement system of the road surface state according to the embodiments described hereinafter is applied, the measurement work flow for a road surface state is performed in the following sequence.

At first, a road surface condition measurement vehicle 110 travels on a vehicle road (i.e., a vehicle road A) to be inspected. In order to derive the MCI values, the road surface condition measurement vehicle 110 travels on the vehicle road A to perform measurement (referred to as "road surface condition measurement") such as a step measurement of the road with a laser scan unit, road surface imaging with a camera image capturing part, etc.

When the road surface condition measurement has been completed, the MCI value is derived for the kilometer post section based on the analysis of road surface condition measurement information obtained by the road surface condition measurement, on a kilometer post section basis, and MCI information 500 in which the derived MCI values are associated with the kilometer post sections is generated.

It is noted that the kilometer post is a road post indicating a distance from a predetermined start point, and is disposed every 1 km or 100 m. Further, the kilometer post section starts from a certain kilometer post and ends at the next kilometer post (i.e., the section between the neighboring kilometer posts). The layout positions of the kilometer posts are defined in advance in kilometer post layout position information 400 described hereinafter.

Next, a portable apparatus, which includes a sensor for detecting information related to the vibration and a sensor for detecting information related to the current position, is installed in a patrol vehicle 120 which patrols the vehicle road A at a certain interval. The portable apparatus is a smart phone, etc., for example, and performs abbreviated measurement for the road surface state. Specifically, the portable apparatus generates measurement information 600 including acceleration in the up-and-down direction, for example, as the information related to the vibration and latitude and longitude, for example, as the information related to the current position.

The measurement information 600 is used to derive the evaluation indicative of a progress of the degradation of the road surface. The relationship between the measurement information 600 and the evaluation value is predetermined in evaluation value information 700 described hereinafter, and the evaluation value is derived, on a kilometer post basis, based on the evaluation value information 700.

The evaluation value is derived, on a kilometer post basis, whenever the patrol vehicle 120 travels on the vehicle road A, and accumulation value thereof is calculated on a kilometer post basis. The accumulation value of the evaluations on a kilometer post basis is associated with the corresponding kilometer posts to be accumulation information 800.

Next, at a lapse of a predetermined term, the measurement system of the road surface state calculates the prediction MCI values based on the MCI values included in the MCI information 500, and the accumulation values included in the accumulation information 800 at a lapse of a predetermined term. Further, the measurement system of the road surface state generates prediction MCI information 900 in which the prediction MCI values are associated with the kilometer post sections.

Next, the measurement system of the road surface state extracts, based on the prediction MCI information 900, the kilometer post section(s) whose prediction MCI value(s) is less than or equal to a predetermined threshold. The kilometer post section(s) thus extracted is a position where the road surface is estimated to be degraded at the lapse of the predetermined term.

Thus, the next road surface condition measurement with the road surface condition measurement vehicle 110 may be performed with respect to the extracted kilometer post section(s).

In this way, according to the measurement system of the road surface state described hereinafter, the section(s) for which the next road surface condition measurement is to be performed is limited, which decreases the cost related to the inspection of the road surface in comparison with a case where the MCI values are derived with respect to the vehicle road as a whole to be inspected.

In the following, the measurement system of the road surface state according to embodiments are described in detail with reference to the attached drawings It is noted that elements that have substantially the same functional configuration are given the same reference number in the specification and the drawings, and redundant explanation thereof is omitted.

First Embodiment

Figure 2:
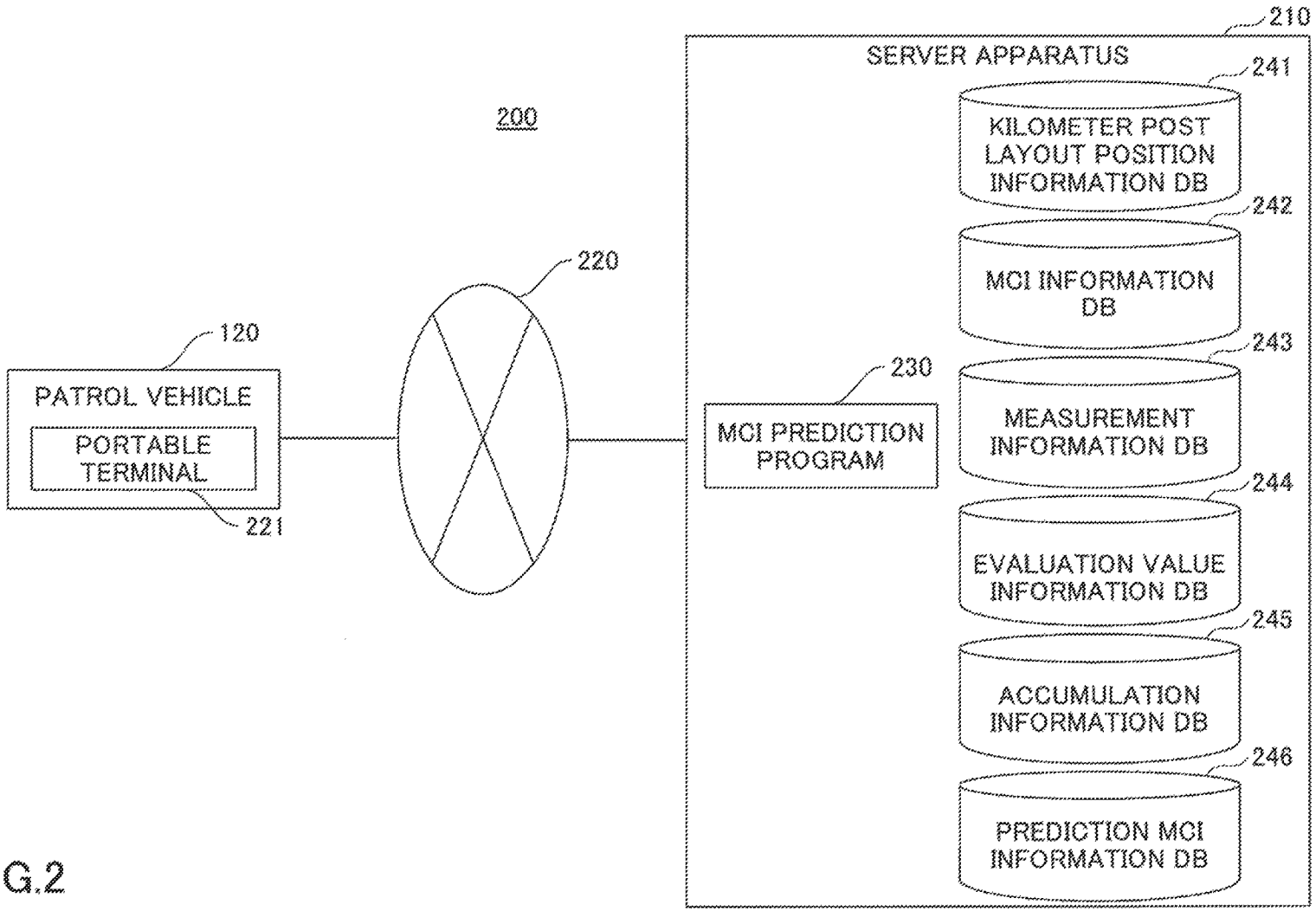
FIG. 2 is a diagram illustrating an example of a system configuration of a measurement system of a road surface state.

At first, a system configuration of a measurement system of a road surface state according to a first embodiment is explained. FIG. 2 is a diagram illustrating an example of a system configuration of a measurement system of a road surface state.

As illustrated in FIG. 2, a measurement system 200 of a road surface state includes a portable terminal 221 and a server apparatus 210. The portable terminal 221 is installed in a patrol vehicle 120. Further, the server apparatus 210 is coupled to the portable terminal 221 via a network 140.

The portable terminal 221 is a smart terminal such as a smart phone, a tablet terminal, etc., and measures information related to vibration of the patrol vehicle 120 and the information related to the current position of the patrol vehicle 120. Further, the portable terminal 221 transmits the measurement information 600 obtained by the measurement to the server apparatus 210.

The server apparatus 210 calculates, based on the MCI information 500 and the measurement information 600, the prediction MCI values to generate the prediction MCI information 900.

The server apparatus 210 according to the embodiment has an MCI prediction program 230 installed therein. Further, the server apparatus 210 according to the embodiment includes a kilometer post layout position information database (a database is referred to as "DB" hereinafter) 241, an MCI information DB 242, and a measurement information DB 243. Further, the server apparatus 210 according to the embodiment includes an evaluation value information DB 244, an accumulation information DB 245, and a prediction MCI information DB 246.

The kilometer post layout position information DB 241 stores kilometer post layout position information 400. The MCI information DB 242 stores the MCI information 500. The measurement information DB 243 stores the measurement information 600. The evaluation value information DB 244 stores the evaluation value information 700. The accumulation information DB 245 stores the accumulation information 800. The prediction MCI information DB 246 stores the prediction MCI information.

It is noted that the respective DBs included in the server apparatus 210 may be provided in a storage 304, etc., described hereinafter, for example. Further, the kilometer post layout position information DB 241, the MCI information DB 242, and the measurement information DB 243 according to the embodiment may be provided in an external apparatus coupled to the server apparatus 210, for example.

Figure 3:
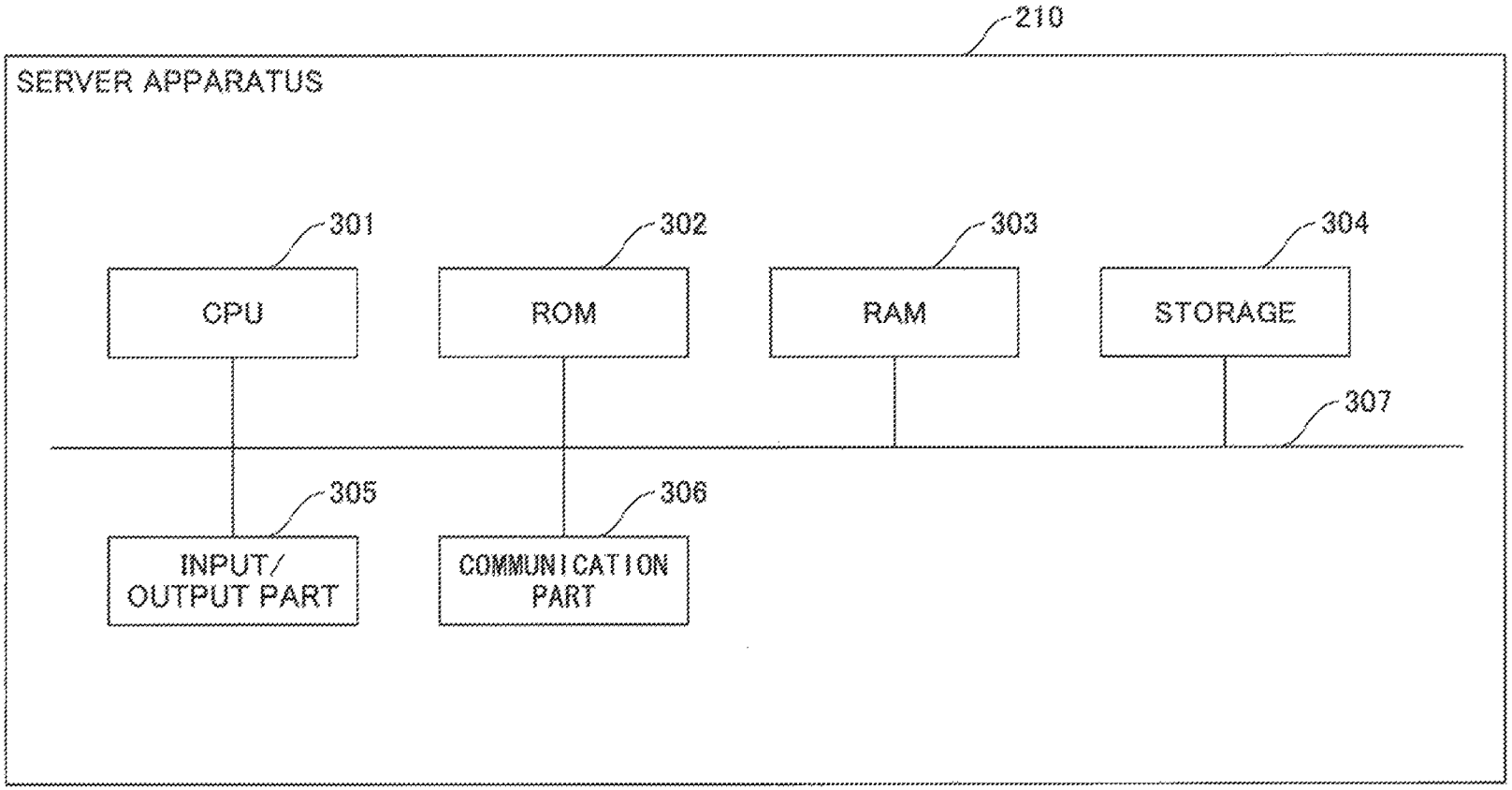
FIG. 3 is a diagram illustrating a hardware configuration of a server apparatus.

Next, the server apparatus 210 is described in detail. FIG. 3 is a diagram illustrating a hardware configuration of the server apparatus. The server apparatus 210 includes a CPU 301, a ROM (Read Only Memory) 302, and a RAM (Random Access Memory) 303. Further, the server apparatus 210 includes a storage 304, an input/output part 305, and a communication part 306. It is noted that parts of the server apparatus 210 are coupled to each other via a bus 307.

The CPU 301 executes programs stored in the storage 304.

The ROM 302 is a nonvolatile memory. The ROM 302 stores programs, data, etc., required for the CPU 301 to execute the programs stored in the 304. Specifically, boot programs such as BIOS (Basic Input/Output System), EFI (Extensible Firmware Interface), etc., are stored.

The RAM 303 is a main memory such as DRAM (Dynamic Random Access Memory), SRAM (Static Random Access Memory), etc. The RAM 303 functions as a work area in which the programs in the storage 304 are expanded at the execution by the CPU 301.

The storage 304 stores programs, information, etc., installed in the server apparatus 210. The input/output part 305 receives instructions to the server apparatus 210. Further, the input/output part 305 displays an internal state of the server apparatus 210. The communication part 306 communicates with the portable terminal 221, etc.

Next, information processed by the server apparatus 210 is described in detail. At first, a concrete example of the kilometer post layout position information 400 is described. FIG. 4 is a diagram illustrating an example of the kilometer post layout position information. It is noted that the kilometer post layout position information is classified on a vehicle road basis, and FIG. 4 is a diagram illustrating an example of the kilometer post layout position information 400 of "vehicle road A" among vehicle roads. The vehicle road A is 10 km long and includes 100 kilometer post sections.

As illustrated in FIG. 4, the kilometer post layout position information 400 includes, as items of information, "kilometer post section name", "start point", and "end point".

In the "kilometer post section name", the names of the kilometer post sections included in the vehicle road A are stored. In the case of the vehicle road A, the names of the kilometer post sections are numbers, and in "kilometer post section name" the numbers corresponding to the names of the kilometer post sections are stored.

In the "start point", the combinations of the latitude and the longitude of the start points of the corresponding kilometer post sections identified by the "kilometer post section names" are stored. Further, in the "end point", the combinations of the latitude and the longitude of the end points of the corresponding kilometer post sections identified by the "kilometer post section names" are stored. In the "end point" of the respective kilometer post sections, the same combinations of the latitude and the longitude as stored in the "start point" of the next kilometer post sections are stored. It is noted that, in FIG. 4, a straight road is illustrated as an example for the sake of simplifying the explanation; however, the actual road is winding, and a kilometer post section includes a plurality of reference points in addition to the start and end points.

In the example illustrated in FIG. 4, the kilometer post section whose "kilometer post section name" is "0.1" corresponds to a section between the kilometer post located at 0 m which corresponds to the start point of the vehicle road A and the kilometer post located at 100 m from the start point. Further, the latitude and the longitude of the start point of the kilometer post section (i.e., the kilometer post located at 0 m which corresponds to the start point) whose "kilometer post section name" is "0.1" is (a0, b0), and the latitude and the longitude of the end point (i.e., the kilometer post located at 100 m from the start point) is (a1, b1).

Similarly, the kilometer post section whose "kilometer post section name" is "0.2" corresponds to a section between the kilometer post located at 100 m from the start point of the vehicle road A and the kilometer post located at 200 m from the start point. Further, the latitude and the longitude of the start point of the kilometer post section (i.e., the kilometer post located at 100 m from the start point) whose "kilometer post section name" is "0.2" is (a1, b1), and the latitude and the longitude of the end point (i.e., the kilometer post located at 200 m from the start point) is (a2, b2). In this way, in the example illustrated in FIG. 4, as the kilometer post layout position information 400, the latitudes and the longitudes of the start points and the end points are stored for the respective kilometer post sections until the kilometer post section whose "kilometer post section name" is "10.0".

Next, a concrete example of the MCI information 500 is described. FIG. 5 is a diagram illustrating an example of the MCI information stored in the server apparatus. As illustrated in FIG. 5, the MCI information 500 includes, as items of information, "vehicle road name", "kilometer post section name", and "MCI value".

In "vehicle road name", names of the vehicle roads for which the MCI values are derived are stored. In the example illustrated in FIG. 5, the MCI value for the vehicle road A has been derived, and thus "vehicle road A" is stored. In the "kilometer post section name", the names of the kilometer post sections for which the MCI values have been derived in the vehicle road A are stored. In "MCI value", the MCI values derived on a kilometer post basis are stored such that the MCI values are associated with the corresponding kilometer post sections.

Next, a concrete example of the measurement information 600 is described. FIG. 6 is a diagram illustrating an example of the measurement information transmitted by the portable terminal. As illustrated in FIG. 6, the measurement information 600 includes, as items of information, "date", "time", "latitude", "longitude", and "vertical acceleration". In the example illustrated in FIG. 6, a case is illustrated in which the latitude, the longitude, and the acceleration in the up-and-down direction are obtained every 0.5 sec.

Next, a concrete example of the evaluation value information 700 is described. FIG. 7 is a diagram illustrating an example of evaluation value information.

As illustrated in FIG. 7, the evaluation value information 700 includes, as items of information, "road surface condition", "evaluation value in case of being greater than or equal to a threshold value VTh1", and "evaluation value in case of being greater than or equal to a threshold value VTh2".

In "road surface condition", information related to the road surface condition, which forms a condition to derive the evaluation value, is stored. Specifically, "prediction MCI value=1" through "prediction MCI value=9" (road surface evaluation value), and "pot hole is there" are stored.

In the "evaluation value in case of being greater than or equal to a predetermined threshold value VTh1", the evaluation values in the case of the accelerations in the up-and-down direction included in the measurement information 600 are greater than or equal to the threshold value Vth1 are stored on a road surface condition-related-information item basis.

In the "evaluation value in case of being greater than or equal to a predetermined threshold value VTh2", the evaluation values in the case of the accelerations in the up-and-down direction included in the measurement information 600 are greater than or equal to the threshold value Vth2 are stored on a road surface condition-related-information item basis.

In the example illustrated in FIG. 7, the evaluation value "1" is derived when the prediction MCI value in a predetermined kilometer post section is in a range between 6 and 9 and the acceleration in the up-and-down direction is greater than or equal to the threshold value VTh1. Further, the evaluation value "2" is derived when the prediction MCI value is in a range between 6 and 9 and the acceleration in the up-and-down direction is greater than or equal to the threshold value VTh2. It is noted that these evaluation values are referred to as a "reference evaluation value".

On the other hand, in the case of the prediction MCI value less than or equal to 5, the evaluation value different from the reference evaluation value is derived. Further, in the case of the pot hole being there, the evaluation value different from the reference evaluation value is derived.

Next, a concrete example of the accumulation information 800 is described. FIG. 8 is a diagram illustrating an example of accumulation information.

As illustrated in FIG. 8, the accumulation information 800 includes, as items of information, "vehicle road name", "kilometer post section name", and "accumulation value".

In the "vehicle road name", names of the vehicle roads for which the accumulation values are derived are stored. In the example illustrated in FIG. 8, the accumulation value for the vehicle road A has been derived, and thus "vehicle road A" is stored. In the "kilometer post section name", the names of the kilometer post sections for which the accumulation values have been derived in the vehicle road A are stored. In the "accumulation value", the accumulation values obtained by adding the evaluation values on a kilometer post basis are stored such that the accumulation values are associated with the corresponding kilometer post sections.

Next, a concrete example of the prediction MCI information 900 is described. FIG. 9 is a diagram for illustrating an example of prediction MCI information.

As illustrated in FIG. 9, the prediction MCI information 900 includes, as items of information, "kilometer post section name", "start point", "end point", and "prediction MCI value".

In the "kilometer post section name", the names of the kilometer post sections for which the prediction MCI values have been derived are stored. In the "start point", the combinations of the latitude and the longitude of the start points of the corresponding kilometer post sections identified by the "kilometer post section names" are stored. Further, in the "end point", the combinations of the latitude and the longitude of the end points of the corresponding kilometer post sections identified by the "kilometer post section names" are stored.

In the "prediction MCI value", the prediction MCI values derived on a kilometer post basis are stored such that the prediction MCI values are associated with the corresponding kilometer post sections. It is noted that in the "prediction MCI value", the MCI values in the respective kilometer post sections are stored as default settings.

Figure 10:
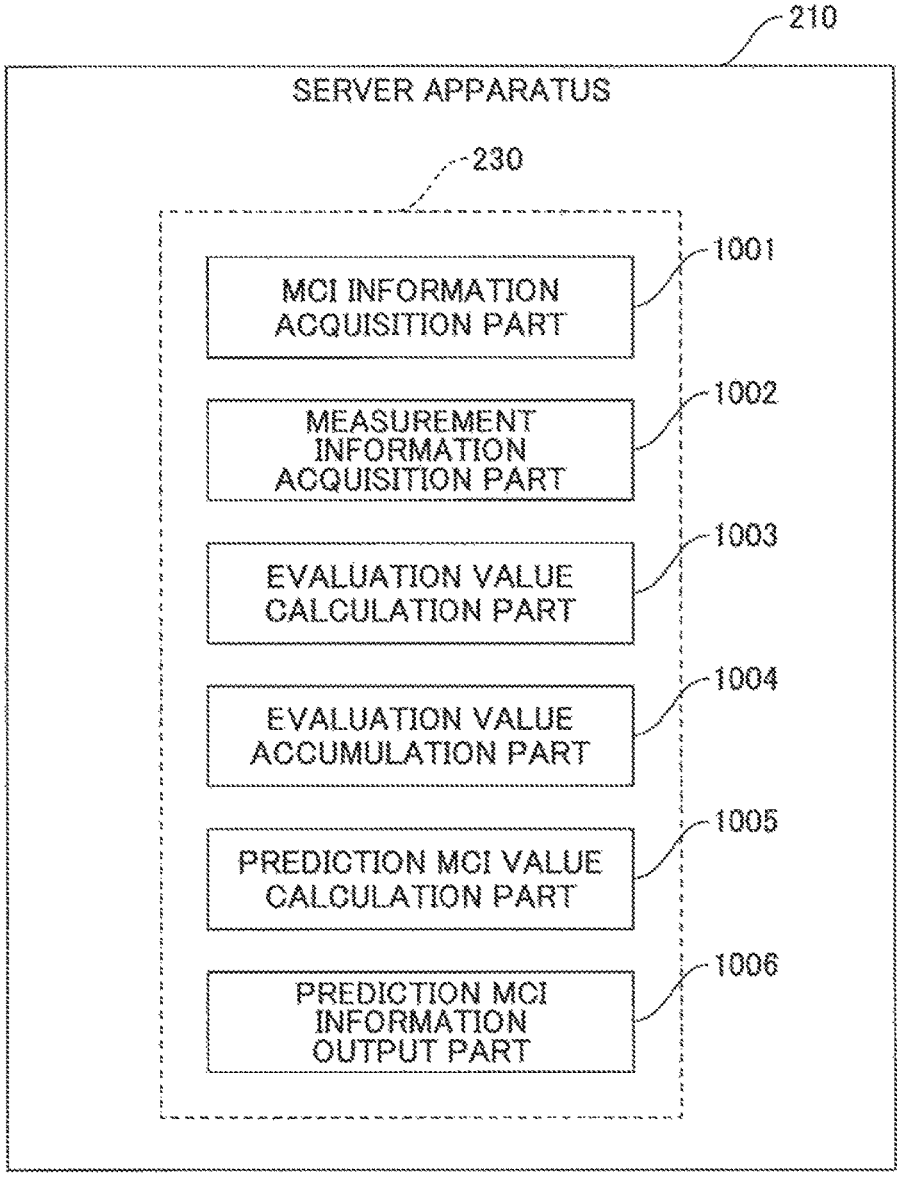
FIG. 10 is a diagram illustrating a function configuration of the server apparatus.

Next, a function configuration of the server apparatus 210, which is an example of a information process apparatus, is described in detail. FIG. 10 is a diagram illustrating a function configuration of the server apparatus.

The server apparatus 210 according to the embodiment has an MCI prediction program 230 installed therein. The server apparatus 210 implements functions of parts described hereinafter by the CPU 301 executing the MCI prediction program 230.

The server apparatus 210 includes an MCI information acquisition part 1001, a measurement information acquisition part 1002, an evaluation value calculation part 1003, an evaluation value value accumulation part 1004, a prediction MCI value calculation part 1005, and a prediction MCI information output part 1006.

The MCI information acquisition part 1001 obtains the MCI information 500 to store the MCI information 500 in the MCI information DB 242. The measurement information acquisition part 1002 obtains the measurement information 600 transmitted by the portable terminal 221 to store the measurement information 600 in the measurement information DB 243.

The evaluation value calculation part 1003 evaluates, based on the measurement information 600 obtained by the measurement information acquisition part 1002, degradation levels of the road surfaces on a kilometer post section basis based on the kilometer post layout position information 400 stored in the kilometer post layout position information DB 241, to derive the evaluation values. Specifically, the accelerations in the up-and-down direction included in the measurement information 600 are compared to the threshold values VTh1 and VTh2 on a kilometer post section basis. Then, if the acceleration in the up-and-down direction are greater than or equal to threshold value VTh1 or VTh2, the evaluation values are derived based on the evaluation value information 700 stored in the evaluation value information DB 244.

It is noted that the evaluation value derived by the evaluation value calculation part 1003 based on the evaluation value information 700 has been adjusted according to the information relate to the road surface condition. Specifically, the evaluation value has been adjusted according to the prediction MCI value at the timing of deriving the evaluation value and the presence or absence of the pot hole.

In this way, the evaluation value calculation part 1003 derives the evaluation values adjusted according to the information related to the road surface condition, which enables the server apparatus 210 to more earlier detect the kilometer post section whose road surface is degraded. In other words, the evaluation value calculation part 1003 deriving the value adjusted according to the information related to the road surface condition is equivalent to changing the detection sensitivity for detecting the kilometer post section whose road surface is degraded.

The evaluation value value accumulation part 1004 calculates the accumulation value by adding the evaluation values derived by the evaluation value calculation part 1003 on a kilometer post section basis, generates the accumulation information 800 including the accumulation values of the kilometer post sections, and stores the accumulation information 800 in the accumulation information DB 245.

The prediction MCI value calculation part 1005 calculates, based on the accumulation information 800 stored in the accumulation information DB 245, the prediction MCI value on a kilometer post section basis. Specifically, at first, the accumulation value stored on a kilometer post section basis in the accumulation information 800 is divided by an evaluation reference value to obtain a quotient thereof. Then, the prediction MCI value is calculated on a kilometer post section basis by subtracting the quotient from the MCI value for the corresponding kilometer post section included in the MCI information 500.

For example, if the evaluation reference value is "20", according to the accumulation information 800 illustrated in FIG. 8, the accumulation value is "30" for the kilometer post whose "kilometer post name" is "0.4", the quotient obtained by dividing the accumulation by the evaluation reference value is "1". According to the MCI information 500 illustrated in FIG. 5, the MCI value is "7" for the kilometer post whose "kilometer post name" is "0.4", and thus the prediction MCI value is 6 (=7−1).

Further, the prediction MCI value calculation part 1005 generates the prediction MCI information 900 in which the prediction MCI values are associated with the kilometer post sections to store the prediction MCI information 900 in the prediction MCI information DB 246.

The prediction MCI information output part 1006 outputs the prediction MCI information 900 stored in the prediction MCI information DB 246 to a recording medium, for example.

Figure 11:
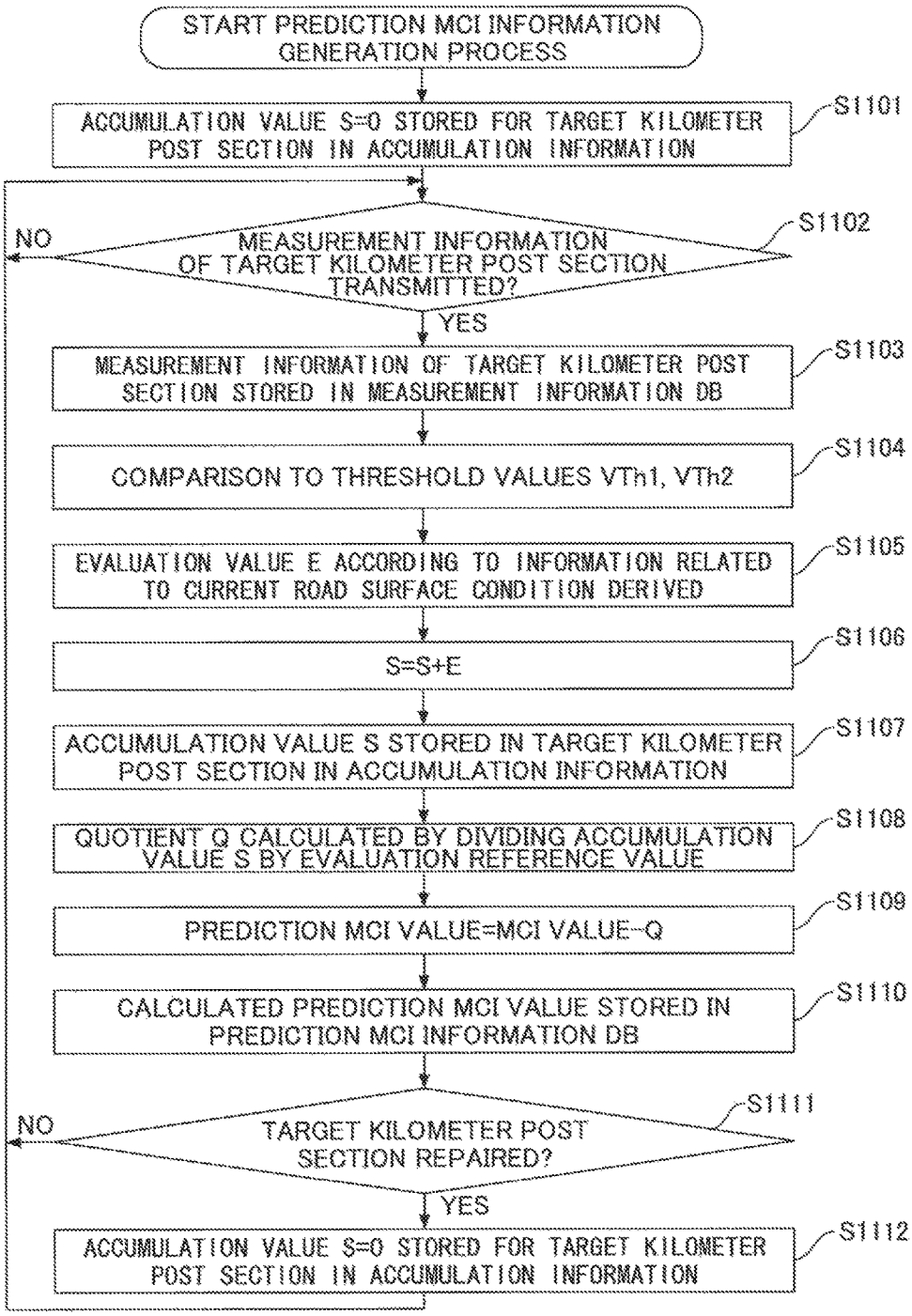
FIG. 11 is a flowchart of a prediction MCI information generation process.

Next, the server apparatus 210 is described in detail. FIG. 11 is a flowchart of a prediction MCI information generation process executed in the server apparatus 210. The flowchart illustrated in FIG. 11 is performed on a kilometer post section basis. It is noted that the MCI information 500 has been stored in the MCI information DB 242 before executing the flowchart illustrated in FIG. 11.

In step S1101, the evaluation value value accumulation part 1004 inserts 0 in the accumulation value S of a target kilometer post section to be processed, among the accumulations of the kilometer post sections included in the accumulation information 800. In step S1102, the measurement information acquisition part 1002 determines whether the measurement information 600 with respect to the target kilometer post section has been transmitted from the portable terminal 221. If it is determined that the measurement information 600 with respect to the target kilometer post section has not been transmitted from the portable terminal 221, the measurement information acquisition part 1002 waits for the transmission of the measurement information 600 for the target kilometer post section.

In step S1102, if it is determined that the measurement information 600 with respect to the target kilometer post section has been transmitted from the portable terminal 221, the measurement information acquisition part 1002 obtains the measurement information 600 with respect to the target kilometer post section. Further, in step S1103, the measurement information acquisition part 1002 stores the obtained measurement information 600 of the target kilometer post section in the measurement information DB 243.

In step S1104, the evaluation value calculation part 1003 compares the accelerations in the up-and-down direction, which are included in the obtained measurement information 600 of the target kilometer post section, to the thresholds VTh1 and VTh2.

In step S1105, the evaluation value calculation part 1003 refers to the evaluation value information 700 to derive the evaluation value E based on the comparison result of the step S1104 and the information related to the road surface condition at present in the target kilometer post section.

In step S1106, the evaluation value value accumulation part 1004 adds the evaluation value E derived in step S1105 to the accumulation value S to update the accumulation value S.

In step S1107, the evaluation value accumulation part 1004 stores the updated accumulation S calculated in step S1106 in the target kilometer post in the accumulation information 800.

In step S1108, the prediction MCI value calculation part 1005 calculates the quotient by dividing the accumulation value S calculated in step S1107 by the evaluation reference value.

In step S1109, the prediction MCI value calculation part 1005 calculates the prediction MCI value by subtracting the quotient from the MCI value of the target kilometer post section in the MCI information 500.

In step S1110, the prediction MCI value calculation part 1005 stores the prediction MCI value calculated in step S1109 in the prediction MCI information DB 246.

In step S1111, the evaluation value accumulation part 1004 determines whether the repair of the road surface with respect to the target kilometer post section has been performed. If it is determined in step S1111 that the repair of the road surface with respect to the target kilometer post section has been performed, the process goes to step S1112 where 0 is inserted in the accumulation value S of the target kilometer post section to return to step S1102. In other words, if the repair of the road surface has been performed, the accumulation value S is reset and the processes from step S1102 through step S1111 are repeated.

On the other hand, if it is determined in step S1111 that the repair of the road surface with respect to the target kilometer post section has not been performed, the process returns to step S1102 to repeat the processes from step S1102 through step S1111.

Here, with reference the drawings (FIG. 12 through FIG. 14), the prediction MCI information generation process according to the embodiment is more specifically described. At first, in the prediction MCI information generation process according to the embodiment, the process of step S1104 in which the comparison between the measurement information and the threshold values VTh1, VTh2 is performed on a kilometer post section basis, and the process of step S1105 in which the evaluation is derived, are explained with reference to FIG. 12 and FIG. 13.

Figure 12:
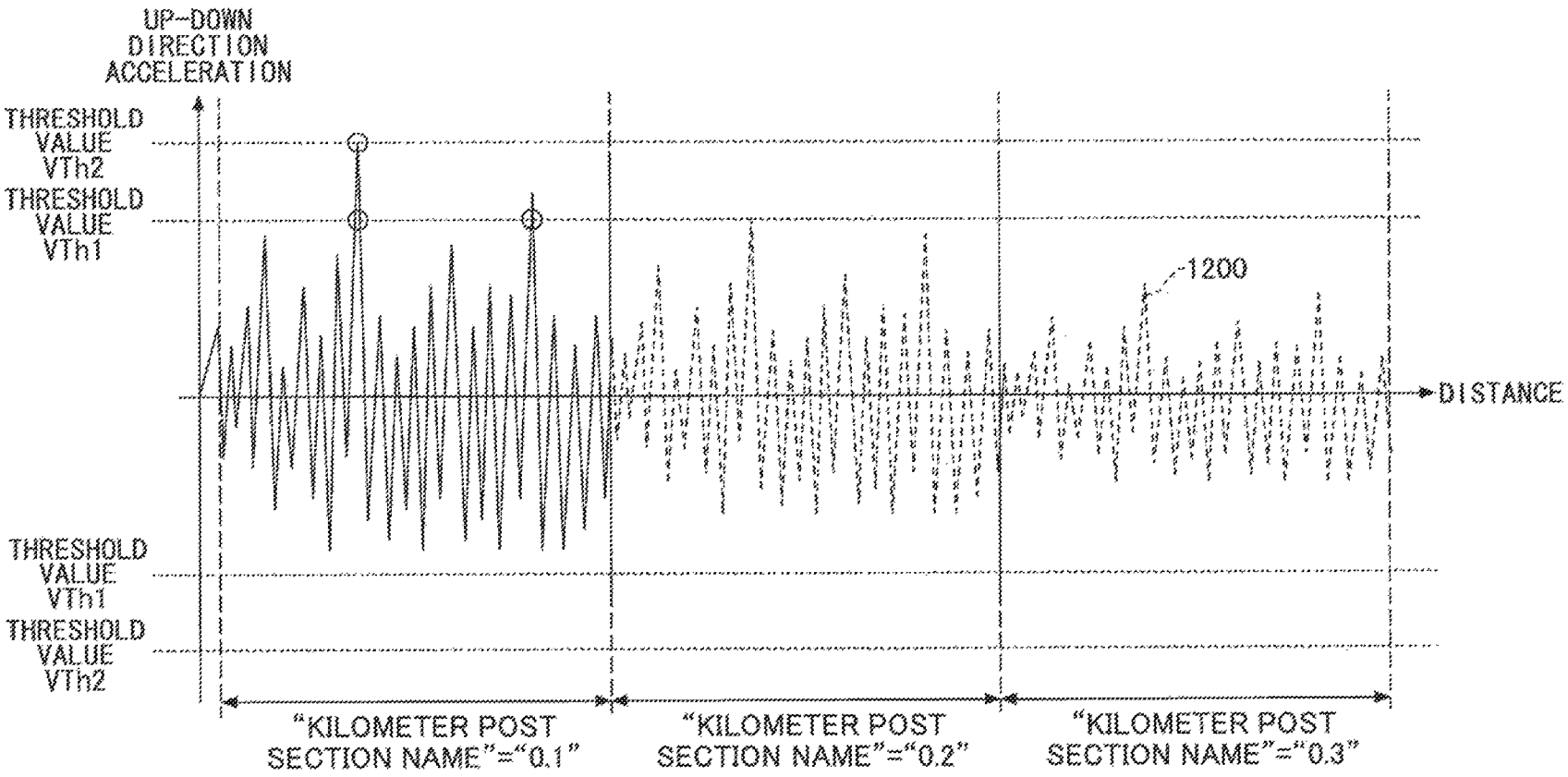
FIG. 12 is a diagram illustrating a relationship between measurement information and thresholds for measurement information.

FIG. 12 is a diagram illustrating a relationship between the measurement information and the thresholds for the measurement information, and FIG. 13 is a diagram illustrating an accumulation process of the evaluation value.

As illustrated in FIG. 12, the evaluation value calculation part 1003 separates the acceleration values in the up-and-down direction 1200 included in the measurement information 600 for the respective kilometer post sections, and performs the comparison between the up-and-down acceleration values 1200 and the threshold values VTh1 and VTh2.

In the example illustrated in FIG. 12, the acceleration in the up-and-down direction from the kilometer post section whose "kilometer post section name" is "0.1" to the kilometer post section whose "kilometer post section name" is "0.3" in the vehicle road A is illustrated. Here, the process of the up-and-down acceleration values 1200 is described in the case where the kilometer post section whose "kilometer post section name" is "0.1" is the target kilometer post section.

As illustrated in FIG. 12, in the kilometer post section whose "kilometer post section name" is "0.1", there are two positions of the travel road surface where the acceleration in the up-and-down direction greater than or equal to the threshold value VTh1 is measured (see circle marks in FIG. 12). For this reason, in the evaluation value calculation part 1003, the evaluation value for the kilometer post section whose "kilometer post section name" is "0.1" is derived according to the information related to the road surface state from the "evaluation value in case of being greater than or equal to a threshold value VTh2" of the evaluation value information 700.

FIG. 13 is a diagram illustrating such an accumulation process in which the evaluations thus derived for the respective kilometer post sections are accumulated on a kilometer post basis every time when the measurement information is obtained. As illustrated in FIG. 13, the evaluation values for the kilometer post sections are derived every time when the measurement information is obtained. It is noted that blanks in FIG. 13 indicate that, as a result of the comparison between the up-and-down acceleration values 1200 and the threshold values VTh1 and VTh2, the acceleration in the up-and-down direction greater than or equal to the threshold value VTh1 or VTh2 has not been detected.

For example, the acceleration in the up-and-down direction in the kilometer post section whose "kilometer post section name" is "0.1", in the acceleration data in the up-and-down direction obtained on "date"="2013 Jan. 10", does not include acceleration in the up-and-down direction greater than or equal to the threshold value VTh1 or VTh2.

On the other hand, the acceleration in the up-and-down direction in the kilometer post section whose "kilometer post section name" is "0.1", among the acceleration in the up-and-down direction obtained on "date"="2013 Mar. 12", includes the acceleration in the up-and-down direction greater than or equal to the threshold value VTh2. It is noted that, as the prediction MCI information 900 illustrated in FIG. 9, the prediction MCI value for the kilometer post section whose "kilometer post section name" is "0.1" on "date"="2013 Mar. 12" is "8" stored therein, and thus the evaluation value "2" is derived (see FIG. 7).

Next, in the prediction MCI information generation process according to the embodiment, the processes from the calculation of the accumulation value S (step S1106) to the determination that the repair of the road surface has been performed (Yes in step S1111) are specifically explained with reference to FIG. 14.

Figure 14:
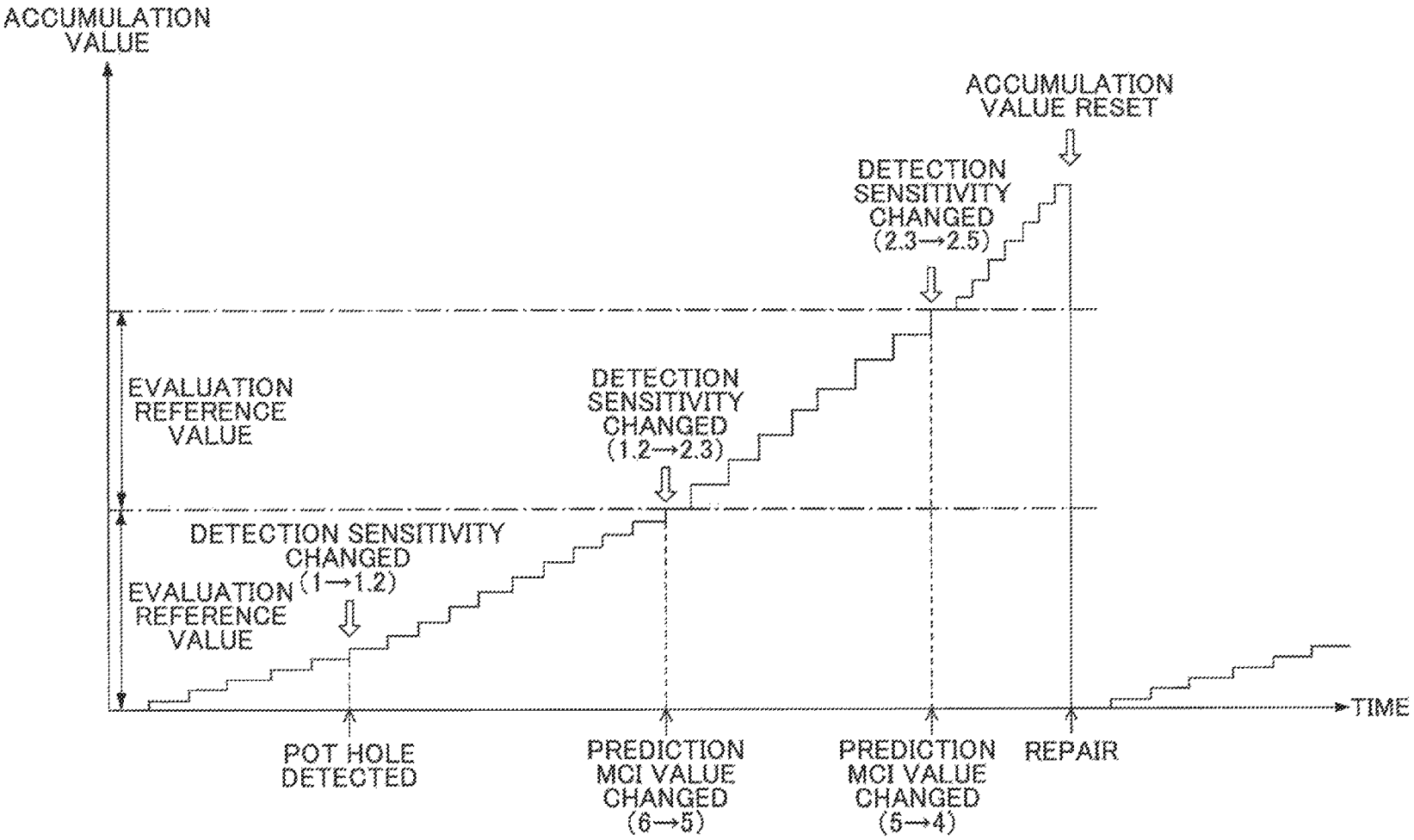
FIG. 14 is a diagram illustrating a change in the accumulation value.

FIG. 14 is a diagram illustrating a change in the accumulation value S in the kilometer post section whose "kilometer post section name" is "0.4".

As illustrated in FIG. 14, if the acceleration in the up-and-down direction included in the measurement information 600 includes an acceleration value greater than or equal to the threshold value VTh1 or VTh2, the evaluation value is added, which causes the accumulation value S to increase with the passage of time. Here, with respect to the kilometer post section whose "kilometer post section name" is "0.4", it is assumed that the pot hole has been detected. If the pot hole has been detected, the evaluation value calculation part 1003 adjusts the evaluation value to increase the detection sensitivity (from 1 to 1.2) for detecting the kilometer post section in which the road surface has been degraded, and increases a gradient of the increase of the accumulation value S after the detection of the pot hole in comparison with that before the detection of the pot hole.

Further, if the quotient obtained by dividing the accumulation value S by the evaluation reference value exceeds 1, the prediction MCI value calculated in the prediction MCI value calculation part 1005 becomes "MCI value−1", which causes the prediction MCI value to change (from 6 to 5). In the case where the prediction MCI value has been changed, the evaluation value calculation part 1003 adjusts the evaluation value to further increase the detection sensitivity (from 1.2 to 2.3) for detecting the kilometer post section in which the road surface has been degraded, and further increases the gradient of the increase of the accumulation value S.

Further, if the quotient obtained by dividing the accumulation value S by the evaluation reference value exceeds 2, the prediction MCI value calculated in the prediction MCI value calculation part 1005 becomes "MCI value−2", which causes the prediction MCI value to change (from 5 to 4). In the case where the prediction MCI value has been changed, the evaluation value calculation part 1003 adjusts the evaluation value to further increase the detection sensitivity (from 2.3 to 2.5) for detecting the kilometer post section in which the road surface has been degraded, and further increases the gradient of the increase of the accumulation value S.

Here, it is assumed that it is determined that the repair of the kilometer post section whose "kilometer post section name" is "0.4" is necessary due to the fact that the prediction MCI value becomes 4. In this case, the road surface condition measurement vehicle 110 performs the road surface condition measurement with respect to the kilometer post section whose "kilometer post section name" is "0.4" to derive the MCI value. Further, the repair work of the road surface based on the derived MCI value is performed. As a result of this, the accumulation value S is reset.

In this way, according to the measurement system 200 of the road surface state, the road surface condition measurement is performed with respect to the vehicle road as a whole to be inspected, and after the MCI value has been derived, the prediction MCI values are calculated based on the measurement information at a plurality of times of the measurement with the portable terminal 221.

For this reason, according to the measurement system 200 of the road surface state, it becomes possible to estimate, with high accuracy, the position where the road surface is degraded at present.

Further, according to the measurement system 200 of the road surface state, the evaluation value according to the information related to the road surface condition is used to calculate the prediction MCI value based on the measurement information at a plurality of times.

For this reason, according to the measurement system 200 of the road surface state, it becomes possible to early detect the position where the road surface is degraded.

Further, according to the measurement system 200 of the road surface state, the measurement target of the road surface condition measurement is limited by calculating the prediction MCI value on a kilometer post section basis.

Thus, according to the measurement system 200 of the road surface state, the cost related to the inspection can be cut with respect to the case where the vehicle road as a whole to be inspected is subject to the measurement with the road surface condition measurement vehicle and the calculation of the MCI values.

Second Embodiment

The evaluation value calculation part 1003 according to the second embodiment amplifies the acceleration in the up-and-down direction included in the measurement information 600 based on the information related to the road surface condition at present in order to increase the detection sensitivity for detecting the kilometer post section in which the road surface is degraded. This arrangement increases the probability that it is determined that the acceleration in the up-and-down direction greater than or equal to the threshold value VTh1 or VTh2 has been detected, which enables increasing the gradient of the increase of the accumulation value S.

Figure 15:
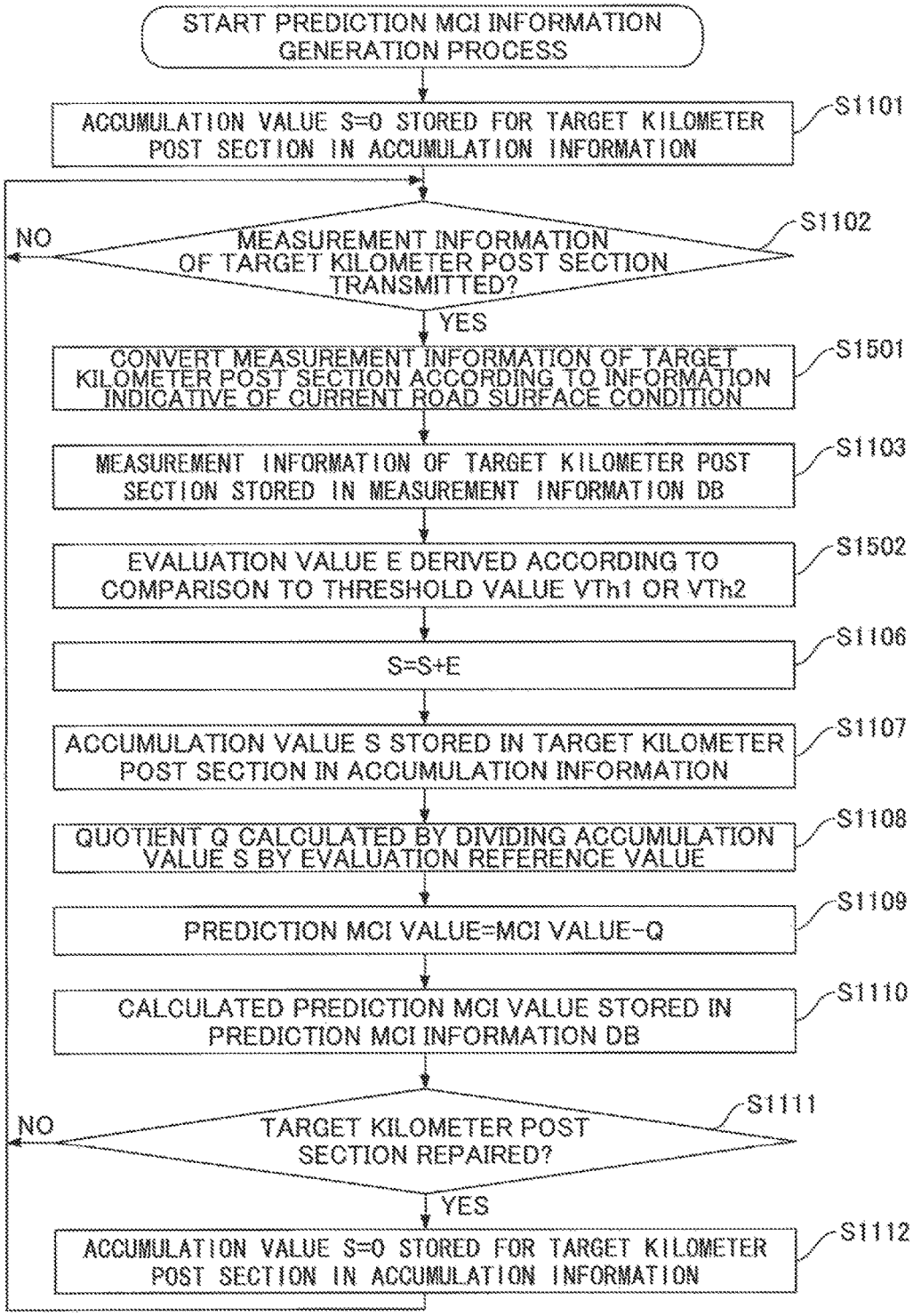
FIG. 15 is a flowchart of a prediction MCI information generation process.

FIG. 15 is a flowchart of the prediction MCI information generation process executed in the server apparatus 210. It is noted that, among the respective processes in the flowchart illustrated in FIG. 15, the same processes as those of the flowchart illustrated in FIG. 11 are given the same reference numerals, and explanation thereof is omitted. Different points with respect to FIG. 11 are related to step S1501 and step S1502.

In step S1501, the evaluation value calculation part 1003 amplifies the acceleration in the up-and-down direction in the measurement information 600 with respect to the target kilometer post section based on the information (the prediction MCI value, the presence or absence of the pot hole) related to the road surface condition at present with respect to the target kilometer post section. For example, if the information related to the road surface condition at present with respect to the target kilometer post section includes the "prediction MCI value"="5" stored in the prediction MCI information DB 246, the acceleration in the up-and-down direction in the target kilometer post section included in the measurement information 600 is amplified by 1.1 times.

In step S1502, the evaluation value calculation part 1003 compares the converted acceleration in the up-and-down direction of the target kilometer post section to the thresholds VTh1 and VTh2. Further, as the result of the comparison, if it is determined that the converted acceleration in the up-and-down direction of the target kilometer post section includes the acceleration greater than or equal to the threshold value VTh1, the evaluation value calculation part 1003 derives the evaluation value "1". Further, as the result of the comparison, if it is determined that the converted acceleration in the up-and-down direction of the target kilometer post section includes the acceleration greater than or equal to the threshold value VTh2, the evaluation value calculation part 1003 derives the evaluation value "2".

In this way, the acceleration in the up-and-down direction included in the measurement information 600 is amplified based on the information related to the road surface state at present, which enables increasing the detection sensitivity for detecting the kilometer post section in which the road surface is degraded.

It is noted that, according to the above explanation, the evaluation values are derived from the converted acceleration in the up-and-down direction in the target kilometer post section, and the evaluation values are accumulated to calculate the accumulation value. However, the converted acceleration itself in the up-and-down direction in the target kilometer post section may be accumulated to calculate the accumulation value and then derive the prediction MCI value. In other words, in order to calculate the prediction MCI value, the measurement information may be accumulated or the evaluations derived based on the measurement information may be accumulated.

Third Embodiment

The prediction MCI information output part 1006 according to the third embodiment separately outputs, among the prediction MCI values included in the prediction MCI information, the prediction MCI value of the kilometer post section for which the number of the acquisition of the measurement information is small, and prediction MCI value of the kilometer post section for which the number of the acquisition of the measurement information is great.

FIG. 16 is a diagram illustrating another example of the prediction MCI information. FIG. 16 is a diagram illustrating an example of the prediction MCI information output by the prediction MCI information output part 1006 according to the third embodiment. In the case of the prediction MCI information 1600 illustrated in FIG. 16, the "prediction MCI value" includes the kilometer post sections for which the prediction MCI values are stored, and the kilometer post sections for which predetermined messages ("low reliability") are stored.

The kilometer post sections for which the prediction MCI values are stored in the "prediction MCI value" indicates that, with respect to such kilometer post sections, the travel with the patrol vehicle 120 has been performed at a plurality of times, and the measurement information has been obtained at a plurality of times. Thus, if the prediction MCI value does not change with respect to the default MCI value, it can be determined that the road surface is not degraded.

On the other hand, the kilometer post sections for which the predetermined messages are stored in the "prediction MCI value" indicates that, with respect to such kilometer post sections, almost no travel with the patrol vehicle 120 is performed, and the measurement information has not been obtained sufficient times. In the case of the kilometer post section for which the measurement information has not been obtained sufficient times, the accumulation value S does not increase and thus the prediction MCI value does not change from the default MCI value. For this reason, if the default MCI value is stored, there is no distinction between the case where it is determined that the road surface is not degraded based on the measurement information obtained at a plurality of times and the case where the prediction MCI value does not change due to the measurement information not obtained at sufficient times. In contrast, as illustrated in FIG. 16, if the predetermined message is stored, such a problem can be prevented.

Fourth Embodiment

In the measurement system of the road surface state according to the fourth embodiment, a navigation system installed in an ordinary vehicle is coupled to a network. Further, the prediction MCI information output part according to the fourth embodiment instructs the alarm output for the navigation system installed in an ordinary vehicle based on the prediction MCI information.

Figure 17:
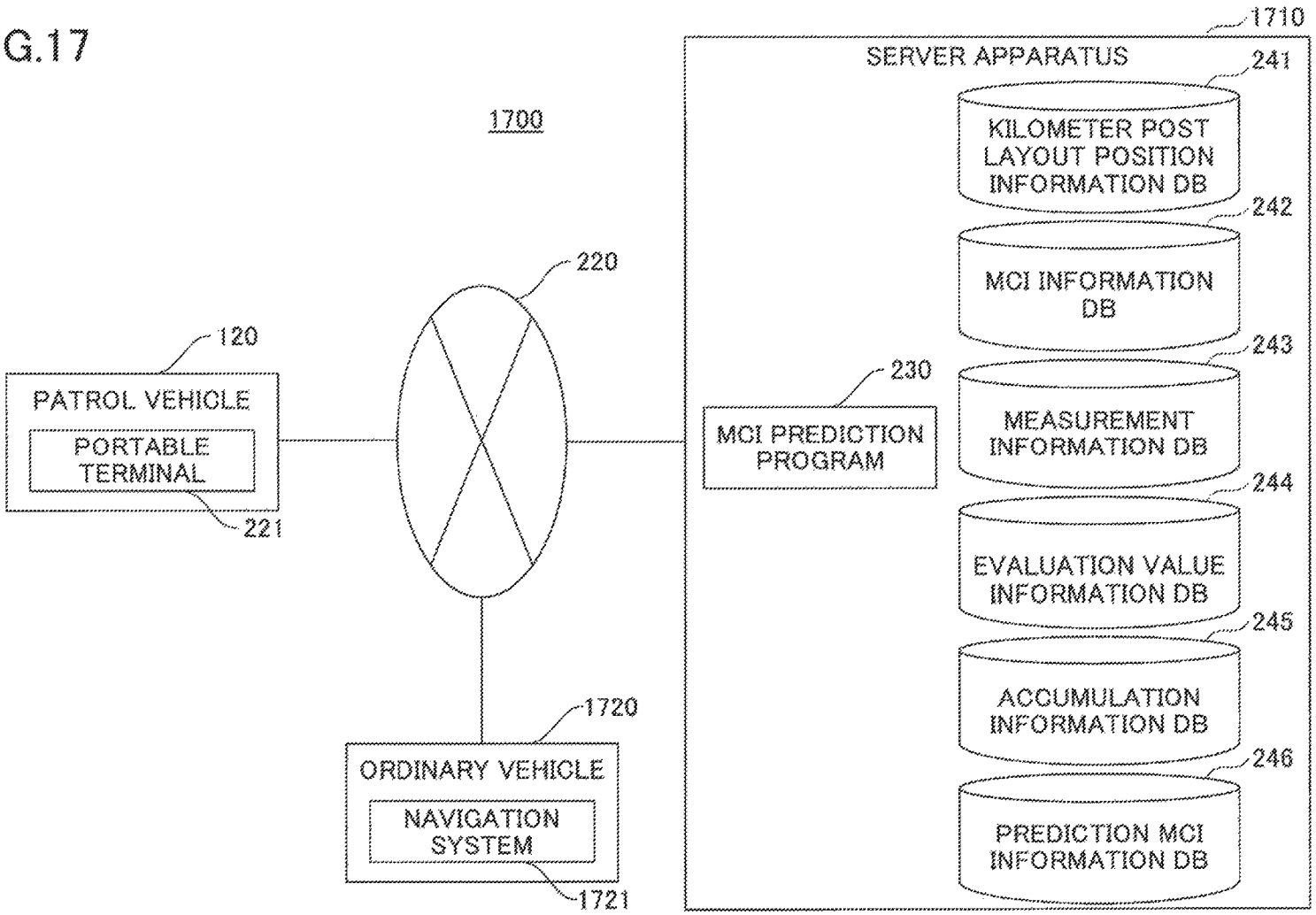
FIG. 17 is a diagram illustrating another example of a system configuration of a measurement system of a road surface state.

FIG. 17 is a diagram illustrating another example of a system configuration of the measurement system of the road surface state. It is noted that, here, the explanation is focused on the difference with respect to the measurement system 200 of the road surface state according to the first embodiment described above with reference to FIG. 2.

In FIG. 17, the measurement system 1700 of the road surface state according to the fourth embodiment includes an ordinary vehicle 1720. The ordinary vehicle 1720 is owned by a user who utilizes the prediction MCI information. The navigation system 1721 is installed in the ordinary vehicle 1720 in which the navigation system 1721 electronically determines the current position and routes to destinations during the travel of the ordinary vehicle 1720.

The navigation system 1721 transmits the latitude and the longitude indicative of the current position to a server apparatus 1710, and outputs the alarm when an alarm instruction based on the prediction MCI information from the server apparatus 1710 is received.

Figure 18:
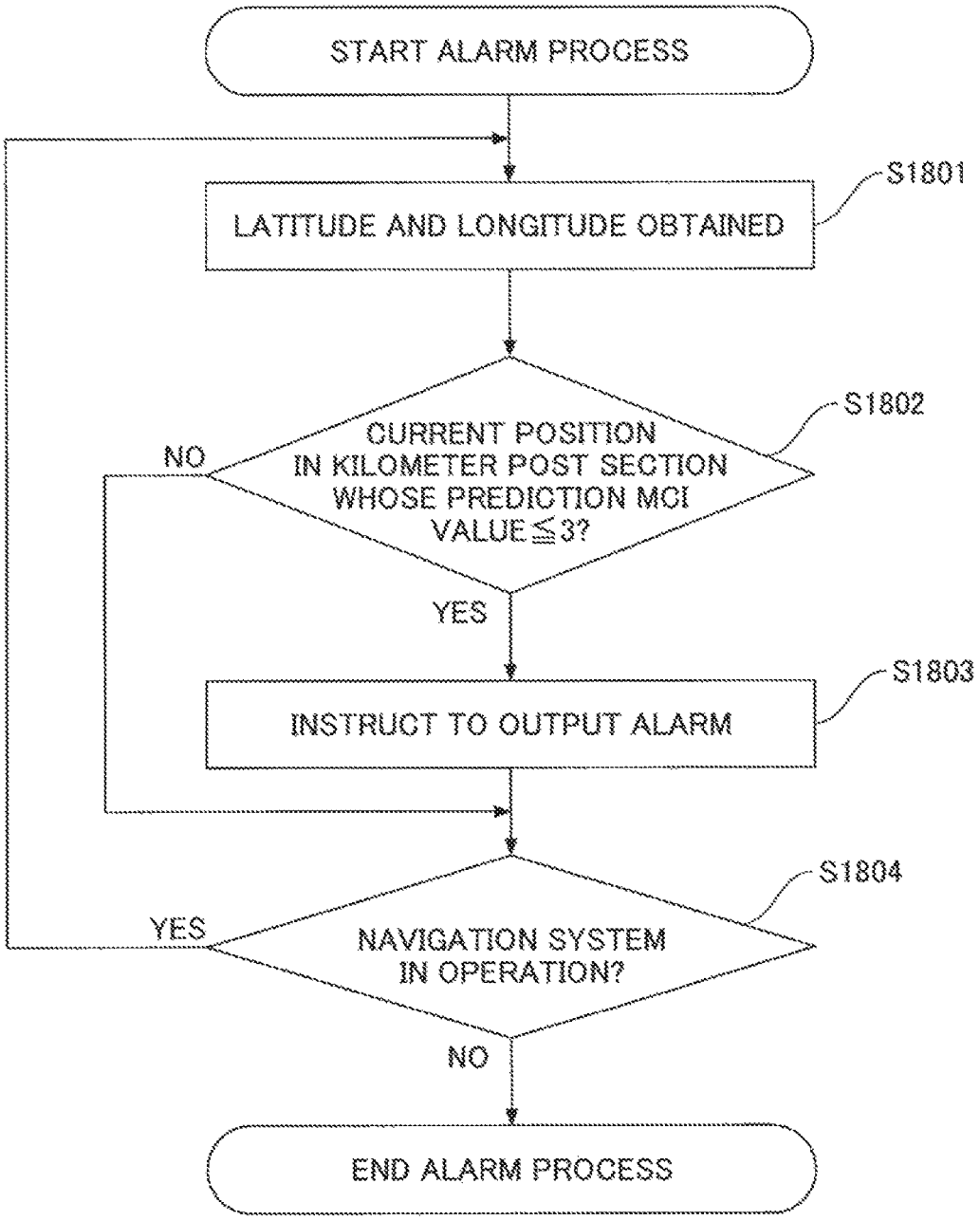
FIG. 18 is a flowchart of an alarm process executed by the server apparatus.

FIG. 18 is a flowchart of an alarm process executed in the server apparatus 1710. The alarm process illustrated in FIG. 18 is performed during a period in which the navigation system 1721 is in operation.

In step S1801, the prediction MCI information output part 1006 receives the latitude and the longitude indicative of the current position from the navigation system 1721.

In step S1802, the prediction MCI information output part 1006 identifies the kilometer post section(s) whose prediction MCI value(s) included in the prediction MCI information is less than or equal to 3, and determines whether the current position received by the navigation system 1721 is included in the identified kilometer post section.

In step S1802, if it is determined that the current position received by the navigation system 1721 is included in the identified kilometer post section, the process goes to step S1803. In step S1803, the prediction MCI information output part 1006 instructs the navigation system 1721 to output the alarm indicative of the travel on the kilometer post section in which the road surface is degraded, and then goes to step S1804.

On the other hand, if it is determined in step S1802 that the current position received by the navigation system 1721 is not included in the identified kilometer post section, the process directly goes to step S1804.

In step S1804, it is determined whether the navigation system 1721 is in operation, and if it is determined that the navigation system 1721 is in operation, the process goes to step S1801. On the other hand, if it is determined that the navigation system 1721 is not in operation, the alarm process ends.

In this way, the prediction MCI information generated in the server apparatus 1710 causes the navigation system of the ordinary vehicle to output the alarm, which enables the user of the ordinary vehicle to perform the drive considering the road surface degradation.

Fifth Embodiment

According to the fifth embodiment, when the prediction MCI information output part 1006 outputs the prediction MCI information, the prediction MCI information output part 1006 extracts the kilometer post section(s) whose prediction MCI value(s) is less than or equal to 3 included in the prediction MCI information to generate and output the prediction MCI information. With this arrangement, it becomes possible to output the prediction MCI information whose data size is decreased.

Sixth Embodiment

According to the respective embodiments described above, the accumulation value is calculated every time when the measurement information is obtained; however, the accumulation value may be calculated after the measurement information at predetermined times has been obtained. In this case, the server apparatus 210 stores the information illustrated in FIG. 13. Further, the server apparatus 210 also stores the kilometer post section for which the repair has been performed and the date and time of the repair. Further, in calculating the accumulation value, the server apparatus 210 performs accumulation of the evaluation values derived based on the measurement information obtained after the date and time of the repair.

Further, according to the embodiments described above, the acceleration in the up-and-down direction is used as the information related to the vibration of the patrol vehicle 120; however, the information related to the vibration is not limited to the acceleration in the up-and-down direction. For example, an angular velocity may be detected or a vibration amplitude may be detected.

It is noted that the present invention is not limited to configurations disclosed herein, such as the configurations in the embodiments described above and any combination with other elements. With respect to these points, various changes could be determined appropriately without departing from the spirit of the invention, and applications thereof could be determined appropriately.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A non-transitory computer-readable recording medium having stored therein a program for causing a computer to execute a process, the process comprising:

changing, when detecting a road surface degradation with respect to a first road surface position based on accumulation of measurement values at a plurality of times of a travel of a vehicle on the first road surface position, detection sensitivity for the road surface degradation according to a road surface evaluation value associated with the first road surface position, the measurement values being measured with an acceleration sensor installed in the vehicle and being according to road surface positions on which the vehicle has traveled.

2. The non-transitory computer-readable recording medium of claim 1, wherein the changing includes changing the detection sensitivity for the road surface degradation such that the detection sensitivity for the road surface degradation becomes higher as the road surface evaluation value indicates more increased degradation state of the road surface.

3. The non-transitory computer-readable recording medium of claim 1, wherein the road surface evaluation value is an MCI value.

4. The non-transitory computer-readable recording medium of claim 1, wherein the process further includes instructing, when the vehicle travels the first road surface position at which the road surface degradation has been detected, an alarm to be output in the vehicle.

5. The non-transitory computer-readable recording medium of claim 1, wherein the process further includes storing date and time information at which the measurement values with respect to the first road surface position have been measured; and determining, when receiving a repair date and time of the first road surface position that has been repaired, the measurement values measured on date and time after the repair date and time as a target to be accumulated.

6. An information process apparatus, comprising a processor configured to change, when detecting a road surface degradation with respect to a first road surface position based on accumulation of measurement values at a plurality of times of a travel of a vehicle on the first road surface position, detection sensitivity for the road surface degradation according to a road surface evaluation value associated with the first road surface position, the measurement values being measured with an acceleration sensor installed in the vehicle and being according to road surface positions on which the vehicle has traveled.

7. A method of detecting a road surface degradation, the method comprising:

using a processor to change, when detecting a road surface degradation with respect to a first road surface position based on accumulation of measurement values at a plurality of times of a travel of a vehicle on the first road surface position, detection sensitivity for the road surface degradation according to a road surface evaluation value associated with the first road surface position, the measurement values being measured with an acceleration sensor installed in the vehicle and being according to road surface positions on which the vehicle has traveled.

* * * * *